US011298576B2

(12) United States Patent
Yoo

(10) Patent No.: US 11,298,576 B2
(45) Date of Patent: Apr. 12, 2022

(54) LENGTH ADJUSTMENT MODULE, INCLINATION ADJUSTMENT APPARATUS, AND TREADMILL INCLUDING THE INCLINATION ADJUSTMENT APPARATUS

(71) Applicant: DRAX INC., Anyang-si (KR)

(72) Inventor: Seon Kyung Yoo, Seoul (KR)

(73) Assignee: Drax Inc., Anyang-si (KR)

( * ) Notice: Subject to any disclaimer, the term of this patent is extended or adjusted under 35 U.S.C. 154(b) by 117 days.

(21) Appl. No.: 16/723,040

(22) Filed: Dec. 20, 2019

(65) Prior Publication Data

US 2021/0069540 A1 Mar. 11, 2021

(30) Foreign Application Priority Data

Sep. 6, 2019 (KR) ..... 10-2019-0110773

(51) Int. Cl.
*A63B 21/00* (2006.01)
*A63B 22/02* (2006.01)

(52) U.S. Cl.
CPC ..... *A63B 21/00069* (2013.01); *A63B 21/154* (2013.01); *A63B 22/0235* (2013.01); *A63B 2225/093* (2013.01)

(58) Field of Classification Search
CPC ..... A63B 21/00069; A63B 21/154; A63B 22/0235; A63B 2225/093; A63B 22/0023; A63B 2225/09; A63B 22/02–0292
See application file for complete search history.

(56) References Cited

U.S. PATENT DOCUMENTS 6,695,751 B1 * 2/2004 Hsu ..... A63B 22/02 482/54
6,730,002 B2 * 5/2004 Hald ..... A63B 22/0023 482/51

(Continued)

FOREIGN PATENT DOCUMENTS

CN 108339230 A 7/2018
CN 108355296 A 8/2018

(Continued)

OTHER PUBLICATIONS

International Search Report and Written Opinion of corresponding PCT Application No. PCT/KR2019/014053—13 pages (dated Jun. 5, 2020).

(Continued)

*Primary Examiner* — Andrew S Lo
(74) *Attorney, Agent, or Firm* — Knobbe Martens Olson & Bear LLP

(57) ABSTRACT

A treadmill is provided. The treadmill includes an inclination adjustment apparatus configured to adjust an inclination of a track unit, wherein the inclination adjustment apparatus includes a length adjustment module of which a length is adjustable. The length adjustment module includes a driving motor, a first length adjustment member of which a length is adjustable by a driving force of the driving motor and a connection belt partially wound around the first length adjustment member. The length adjustment module also includes a second length adjustment member arranged in parallel to the first length adjustment member, connected to the first length adjustment member by the connection belt, and having a length that is adjustable by the driving force of the driving motor received through the first length adjustment member and the connection belt.

15 Claims, 9 Drawing Sheets

(56) References Cited

U.S. PATENT DOCUMENTS

| | | | | |
|---|---|---|---|---|
| 7,211,029 | B2 * | 5/2007 | Kau | A63B 22/02 482/54 |
| 2007/0225126 | A1 * | 9/2007 | Yoo | A63B 22/0235 482/54 |
| 2014/0274579 | A1 | 9/2014 | Olson | |
| 2018/0154208 | A1 | 6/2018 | Powell et al. | |

FOREIGN PATENT DOCUMENTS

| | | | |
|---|---|---|---|
| CN | 108785976 | A | 11/2018 |
| CN | 110064166 | A | 7/2019 |
| CN | 209092627 | U | 7/2019 |
| EP | 2815792 | A2 | 12/2014 |
| KR | 10-2004-0087021 | A | 10/2004 |
| KR | 10-2005-0087181 | A | 8/2005 |

OTHER PUBLICATIONS

First Office Action of Chinese Patent Application No. 201911363341.4—35 pages (dated Jun. 2, 2021).

* cited by examiner

LENGTH ADJUSTMENT MODULE, INCLINATION ADJUSTMENT APPARATUS, AND TREADMILL INCLUDING THE INCLINATION ADJUSTMENT APPARATUS

CROSS-REFERENCE TO RELATED APPLICATION

This application claims the benefit of Korean Patent Application No. 10-2019-0110773, filed on Sep. 6, 2019, in the Korean Intellectual Property Office, the disclosure of which is incorporated herein in its entirety by reference.

BACKGROUND

1. Field

One or more embodiments relate to a length adjustment module, an inclination adjustment apparatus, and a treadmill including the inclination adjustment apparatus.

2. Description of the Related Technology

A treadmill, also called a running machine, is an exercise machine that may provide an exercise effect of walking or running in a narrow space by using a belt that rotates on a caterpillar. Because treadmills may enable walking or running exercise indoors at moderate temperatures regardless of weather, the demand thereof has rapidly increased day by day.

SUMMARY

A treadmill may additionally include an inclination adjustment apparatus capable of adjusting the inclination of a track unit in order to maximize the exercise effect or provide various exercise environments. Incidentally, such inclination adjustment apparatuses may be classified into a single-type inclination adjustment apparatus for adjusting the inclination by one length adjustment member and a dual-type inclination adjustment apparatus for adjusting the inclination by two length adjustment members. The single-type inclination adjustment apparatus may have the advantage that its structure is simple but may have the disadvantage that the stability of the track unit is low. On the other hand, compared to the single-type inclination adjustment apparatus, the dual-type inclination adjustment apparatus may have the advantage that the track unit is stable but may have the disadvantage that a structure for simultaneously operating two length adjustment members is complex and its size is large.

One or more embodiments include a length adjustment module, an inclination adjustment apparatus, and a treadmill including the same, which may have a simple structure and may minimize a size increase thereof while securing the stability of a track unit.

Additional aspects will be set forth in part in the description which follows and, in part, will be apparent from the description, or may be learned by practice of the presented embodiments of the disclosure.

According to one or more embodiments, a treadmill includes: a track unit; a support apparatus rotatably supporting the track unit; and an inclination adjustment apparatus configured to adjust an inclination of the track unit, wherein the inclination adjustment apparatus includes a length adjustment module of which a length is adjustable and is configured to vary an inclination angle of the track unit with respect to a floor as the length thereof is adjusted, the length adjustment module includes: a driving motor; a first length adjustment member of which a length is adjustable by a driving force of the driving motor; a connection belt partially wound around the first length adjustment member; and a second length adjustment member arranged in parallel to the first length adjustment member, connected to the first length adjustment member by the connection belt, and having a length that is adjustable by the driving force received from the driving motor through the first length adjustment member and the connection belt, and the connection belt includes: a first curved section wound around the first length adjustment member; a second curved section wound around the second length adjustment member; a first linear section connecting one end portion of the first curved section to one end portion of the second curved section; and a second linear section connecting another end portion of the first curved section to another end portion of the second curved section and corresponding to the first linear section.

In an embodiment, the first length adjustment member may include: a driving screw rotatably driven by the driving motor; a driving pulley arranged at an end portion of the driving screw and around which the connection belt is partially wound; and a first movement unit moving in a lengthwise direction thereof and having a driving female screw unit formed at an inner circumferential surface thereof and engaging with a thread of the driving screw, and the second length adjustment member may include: a driven screw arranged in parallel to the driving screw; a driven pulley arranged at an end portion of the driven screw and around which the connection belt is partially wound; and a second movement unit moving in a lengthwise direction thereof and having a driven female screw unit formed at an inner circumferential surface thereof and engaging with a thread of the driven screw.

In an embodiment, a distance between the first linear section and the second linear section of the connection belt may correspond to a diameter of the driving pulley or a diameter of the driven pulley.

In an embodiment, the treadmill may further include a module box for storing the driving pulley, the driven pulley, and the connection belt.

In an embodiment, a width of the module box may be larger than the diameter of the driving pulley and may be less than about 120% of the diameter of the driving pulley.

In an embodiment, the treadmill may further include a support pole for supporting the module box to be pivotable around a virtual line connecting a rotation axis of the driving pulley to a rotation axis of the driven pulley.

In an embodiment, a height of the support pole may be less than or equal to about 12 cm.

In an embodiment, the treadmill may further include a track driving unit arranged in front of the track unit to rotatably drive the track unit, wherein the track driving unit may include: a front housing; and a track driving motor stored in the front housing to rotatably drive the track unit.

In an embodiment, the support pole may be arranged in the front housing, and a maximum height of the front housing with respect to the track unit may be less than or equal to about 15 cm.

In an embodiment, the track driving motor may be heavier than the driving motor, and the track driving motor may be arranged to be closer to a center of the front housing than the driving motor.

In an embodiment, the treadmill may further include a tension applying structure configured to press the second length adjustment member away from the first length adjustment member.

According to one or more embodiments, an inclination adjustment apparatus includes a length adjustment module of which a length is adjustable to adjust an inclination of a track unit, the length adjustment module includes: a driving motor; a first length adjustment member of which a length is adjustable by a driving force of the driving motor; a connection belt partially wound around the first length adjustment member; and a second length adjustment member arranged in parallel to the first length adjustment member, connected to the first length adjustment member by the connection belt, and having a length adjustable by the driving force of the driving motor received through the first length adjustment member and the connection belt, and the connection belt includes: a first curved section wound around the first length adjustment member; a second curved section wound around the second length adjustment member; a first linear section connecting one end portion of the first curved section to one end portion of the second curved section; and a second linear section connecting another end portion of the first curved section to another end portion of the second curved section and corresponding to the first linear section.

According to one or more embodiments, a length adjustment module of which a length is adjustable includes: a driving motor; a first length adjustment member of which a length is adjustable by a driving force of the driving motor; a connection belt partially wound around the first length adjustment member; and a second length adjustment member arranged in parallel to the first length adjustment member, connected to the first length adjustment member by the connection belt, and having a length adjustable by the driving force of the driving motor received through the first length adjustment member and the connection belt, and the connection belt includes: a first curved section wound around the first length adjustment member; a second curved section wound around the second length adjustment member; a first linear section connecting one end portion of the first curved section to one end portion of the second curved section; and a second linear section connecting another end portion of the first curved section to another end portion of the second curved section and corresponding to the first linear section.

Other aspects, features, and advantages other than those described above will become apparent from the accompanying drawings, the appended claims, and the detailed description of the disclosure.

These general and particular embodiments may be implemented by using a system, a method, a computer program, or a combination of the system, the method, and the computer program.

BRIEF DESCRIPTION OF THE DRAWINGS

The above and other aspects, features, and advantages of certain embodiments of the disclosure will be more apparent from the following description taken in conjunction with the accompanying drawings.

DETAILED DESCRIPTION

Figure 1:
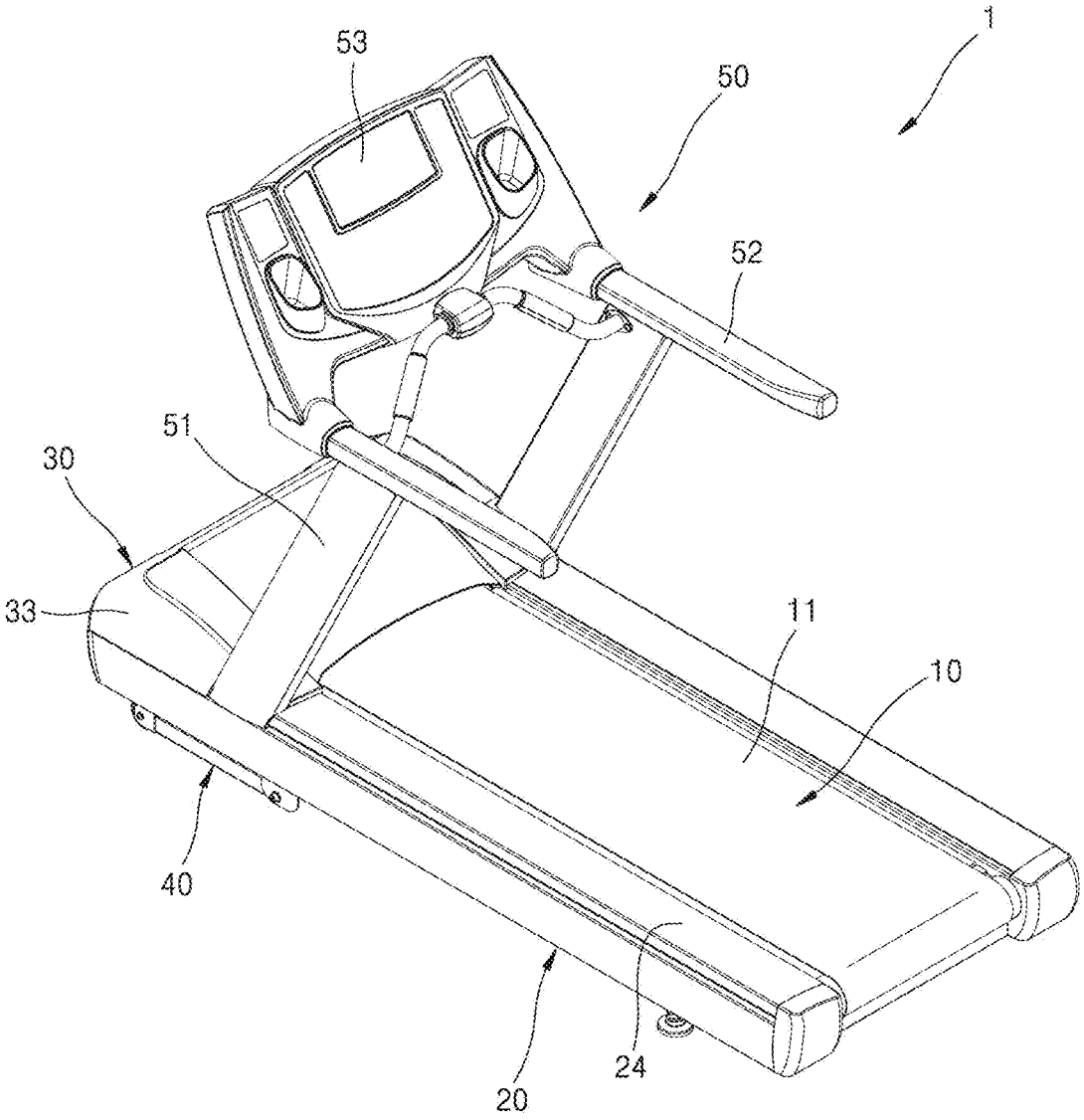
FIG. 1 is a perspective view illustrating a treadmill according to embodiments.

Reference will now be made in detail to embodiments, examples of which are illustrated in the accompanying drawings, wherein like reference numerals refer to like elements throughout. In this regard, embodiments may have different forms and should not be construed as being limited to the descriptions set forth herein. Accordingly, embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Figure 2:
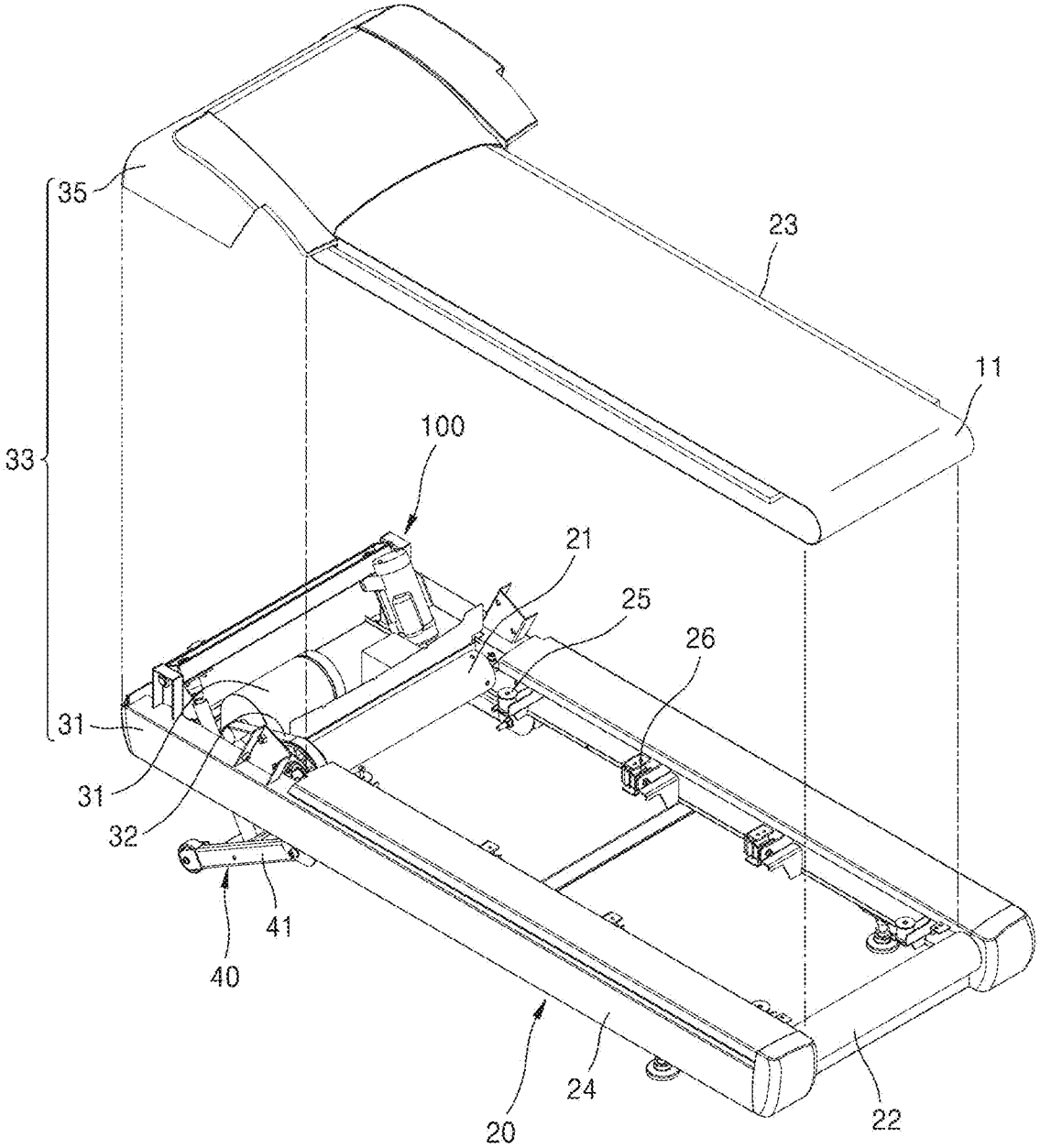
FIG. 2 is a diagram for describing an operation of the treadmill according to embodiments.
Figure 3:
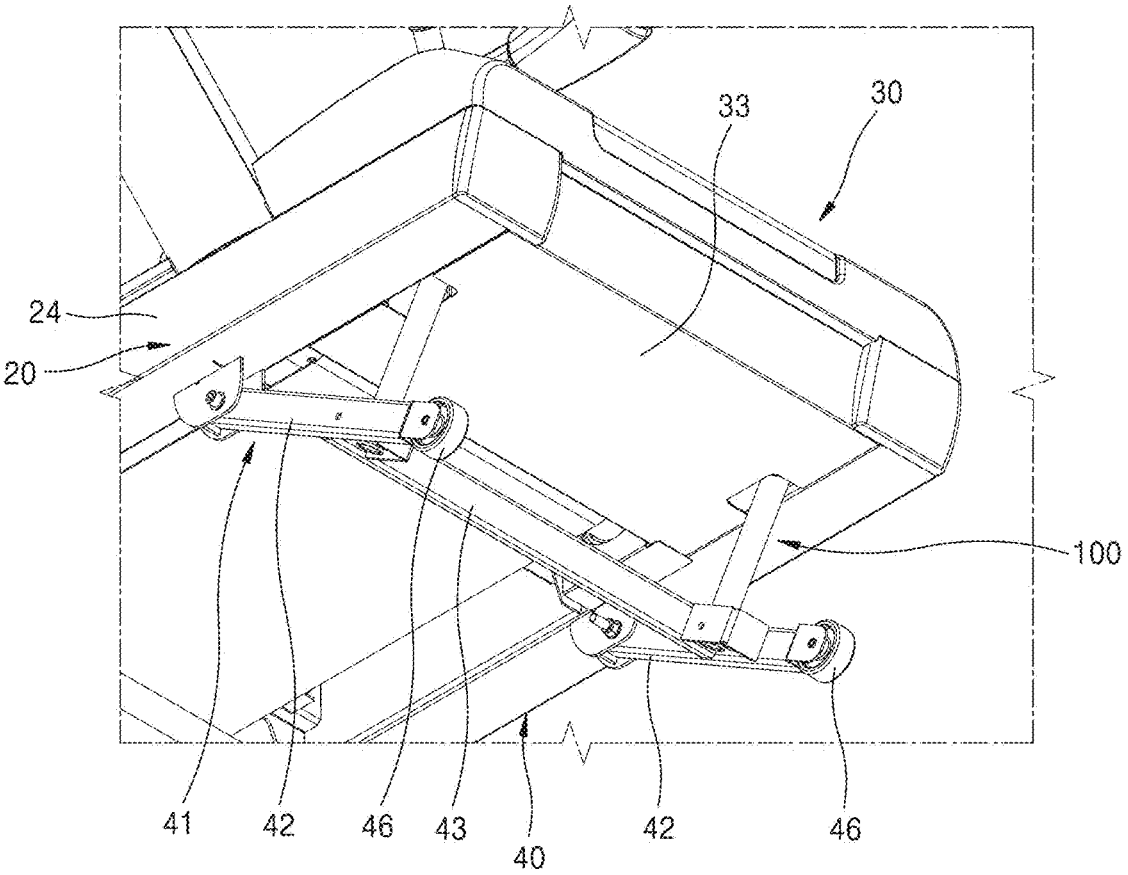
FIG. 3 is a partial perspective view of the treadmill seen from another angle, according to embodiments.
Figure 4:
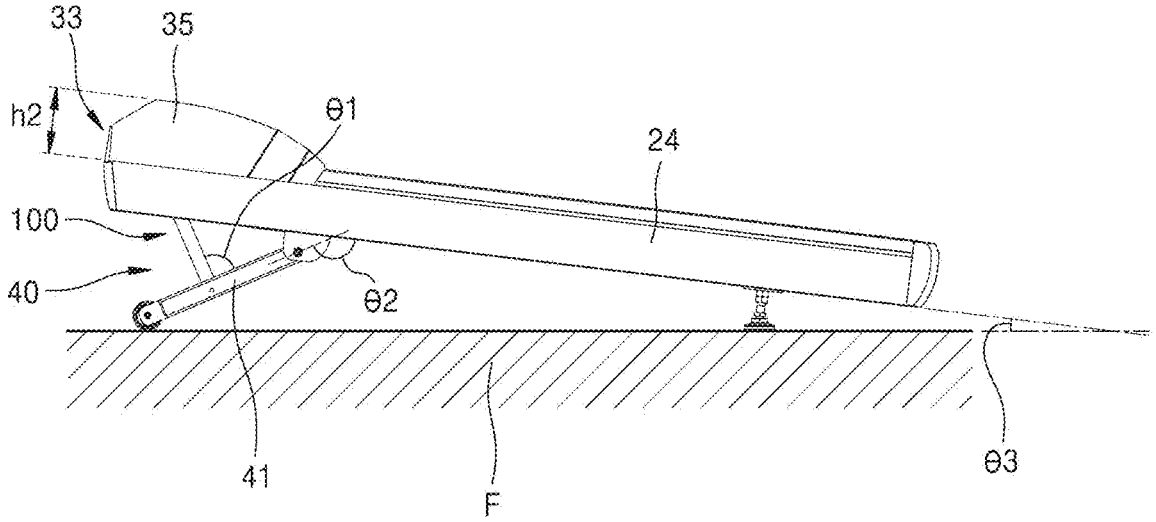
FIG. 4 is a diagram for describing an operation of an inclination adjustment apparatus of FIG. 3.

FIG. 1 is a perspective view illustrating a treadmill 1 according to embodiments, and FIG. 2 is a diagram for describing an operation of the treadmill 1 according to embodiments. FIG. 3 is a partial perspective view of the treadmill 1 according to embodiments, which is viewed at another angle, and FIG. 4 is a diagram for describing an operation of an inclination adjustment apparatus 40 of FIG. 3. In FIG. 2, the illustration of a support unit 50 is omitted for convenience of description.

Referring to FIGS. 1 and 2, the treadmill 1 according to embodiments may include a track unit 10, a support apparatus 20 rotatably supporting the track unit 10, a track driving unit 30 arranged in front of the track unit 10 to rotatably drive the track unit 10, and an inclination adjustment apparatus 40 configured to adjust the inclination of the track unit 10.

The treadmill 1 may further include a support unit 50. The support unit 50 may include a support 51, a handle 52 attached to the other end of the support 51, and a control panel 53 installed to allow the user to enter an exercise program and view exercise information.

The track unit 10 may include a track belt 11 of a caterpillar type. However, the configuration of the track unit 10 is not limited thereto and may be variously modified. For example, although not illustrated in the drawings, the track unit 10 may include a plurality of slats arranged along the rotation direction thereof, instead of the track belt 11.

The track driving unit 30 may include a track driving motor 31 for rotating the track unit 10, a rotation belt 32 connected to the track driving motor 31, and a front housing 33 configured such that the track driving motor 31 and the rotation belt 32 may not be exposed outside. However, the track driving unit 30 may be an optional configuration and the track driving unit 30 may be omitted in a manual treadmill 1 in which the track unit 10 is rotated by the user.

The front housing 33 may include a lower cover 34 and an upper cover 35 detachable from the lower cover 34.

The support apparatus 20 may include a driving roller 21 arranged at a front side thereof, a driven roller 22 arranged at a rear side thereof, a deck 23 arranged between the driving roller 21 and the driven roller 22 and arranged inside the track belt 11, and a support frame 24 configured to support both side portions of the deck 23. The driving roller 21 may be connected to the track driving motor 31 by the rotation belt 32.

Between the support frame 24 and the deck 23, dampers 25 and 26 may be arranged to absorb the impact applied to the deck 23. The dampers 25 and 26 may include a damper 25 for absorbing the force applied vertically to the deck 23 and a damper 26 for absorbing the force applied horizontally to the deck 23.

The inclination adjustment apparatus 40 may be arranged under a front portion of the treadmill 1.

Referring to FIGS. 3 and 4, the inclination adjustment apparatus 40 may include an inclination support unit 41 pivotably connected to the support apparatus 20 and a length adjustment module 100 connected to the inclination support unit 41 and adjustable in length.

The inclination support unit 41 may include a pair of support members 42 and a connection member 43 connecting the pair of support members 42. One end portion of each of the pair of support members 42 may be pivotably connected to the support frame 24 and the other end portion thereof may contact a floor F. A rotation member 46 rotating while contacting the floor F may be arranged at the other end portion of the support member 42.

A portion of the length adjustment module 100 may be exposed outside the front housing 33 of the treadmill 1 and another portion thereof may be arranged inside the front housing 33. The exposed portion of the length adjustment module 100 may be pivotably connected to the inclination support unit 41.

As the length of the length adjustment module 100 is adjusted, an angle 81 between the length adjustment module 100 and the inclination support unit 41 may vary and an angle 82 between the inclination support unit 41 and the support frame 24 may vary. As the angle 82 of the inclination support unit 41 varies, an angle 83 of the track unit 10 and the angle of the support apparatus 20 with respect to the floor F may vary.

Figure 5:
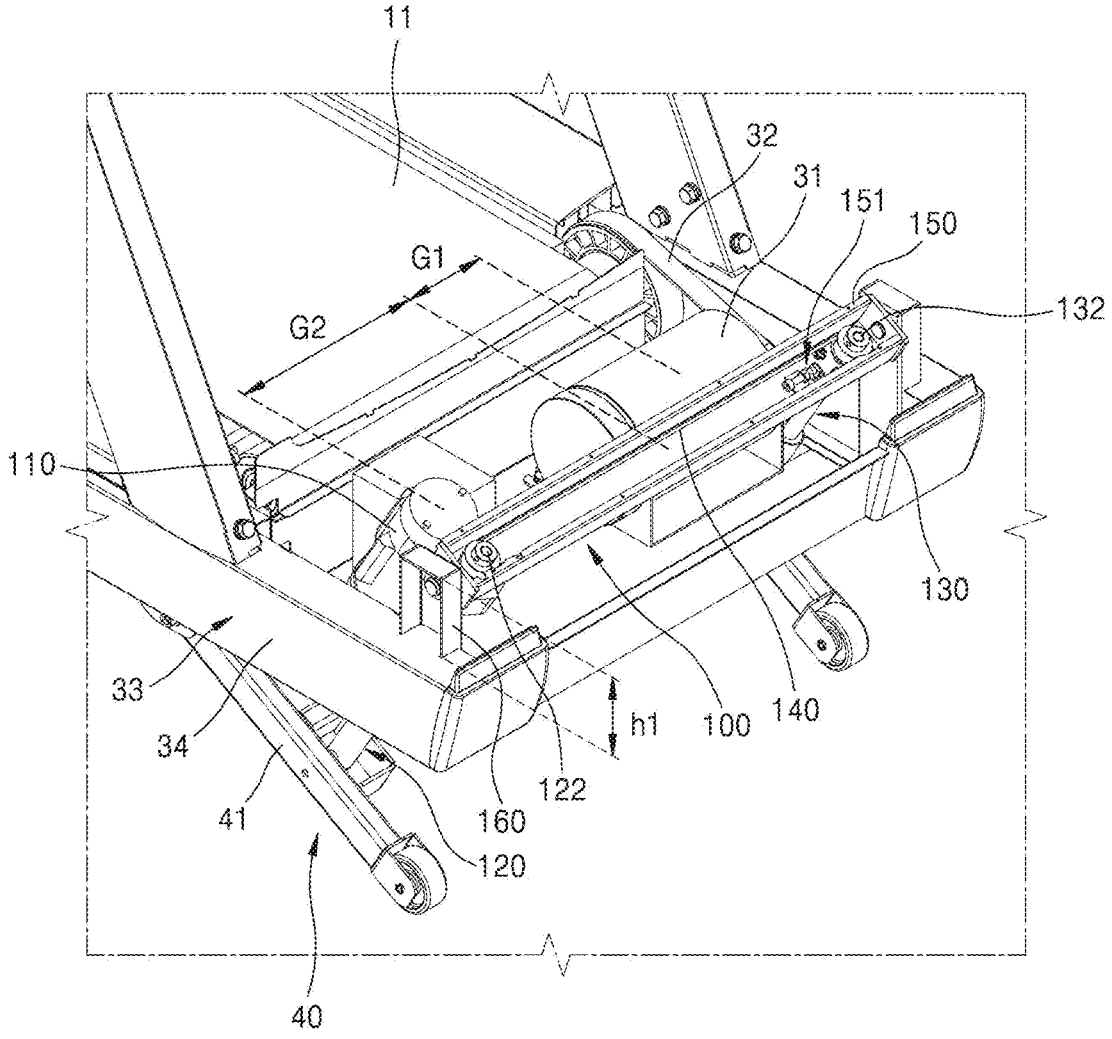
FIG. 5 is a diagram illustrating a state in which an upper cover is removed from a treadmill according to embodiments.
Figure 6:
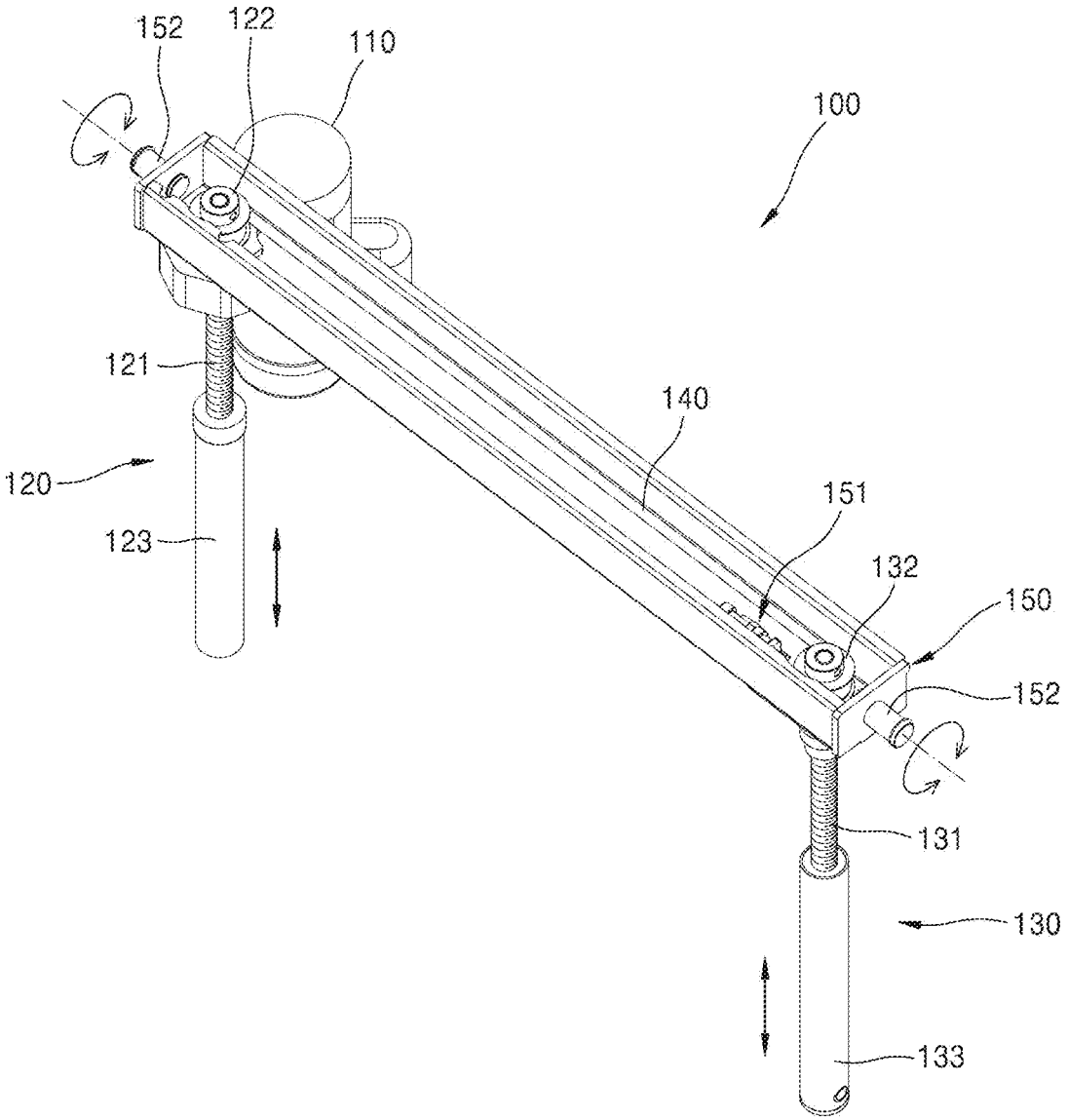
FIG. 6 is a perspective view illustrating from another angle a length adjustment module of FIG. 5.
Figure 7:
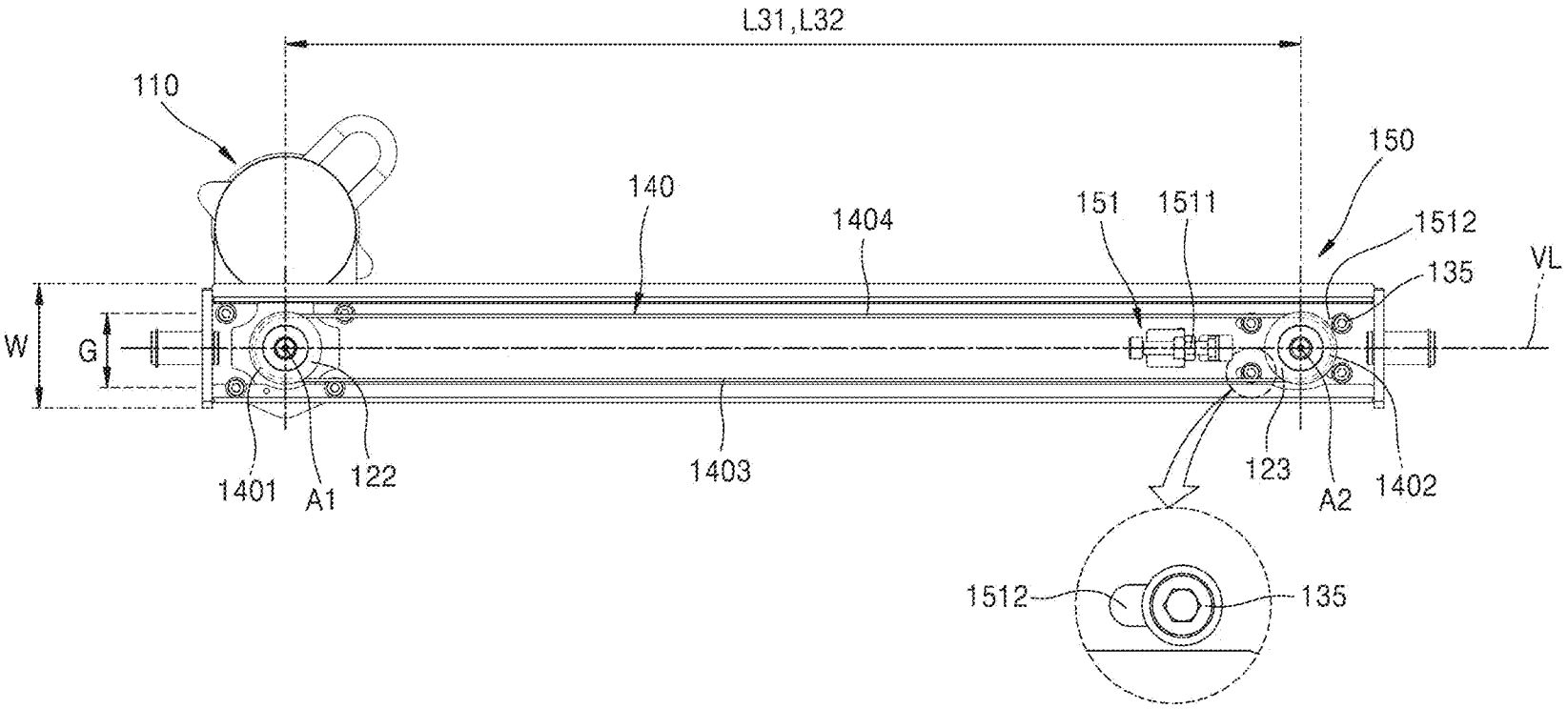
FIG. 7 is a plan view of the length adjustment module of FIG. 6.
Figure 8:
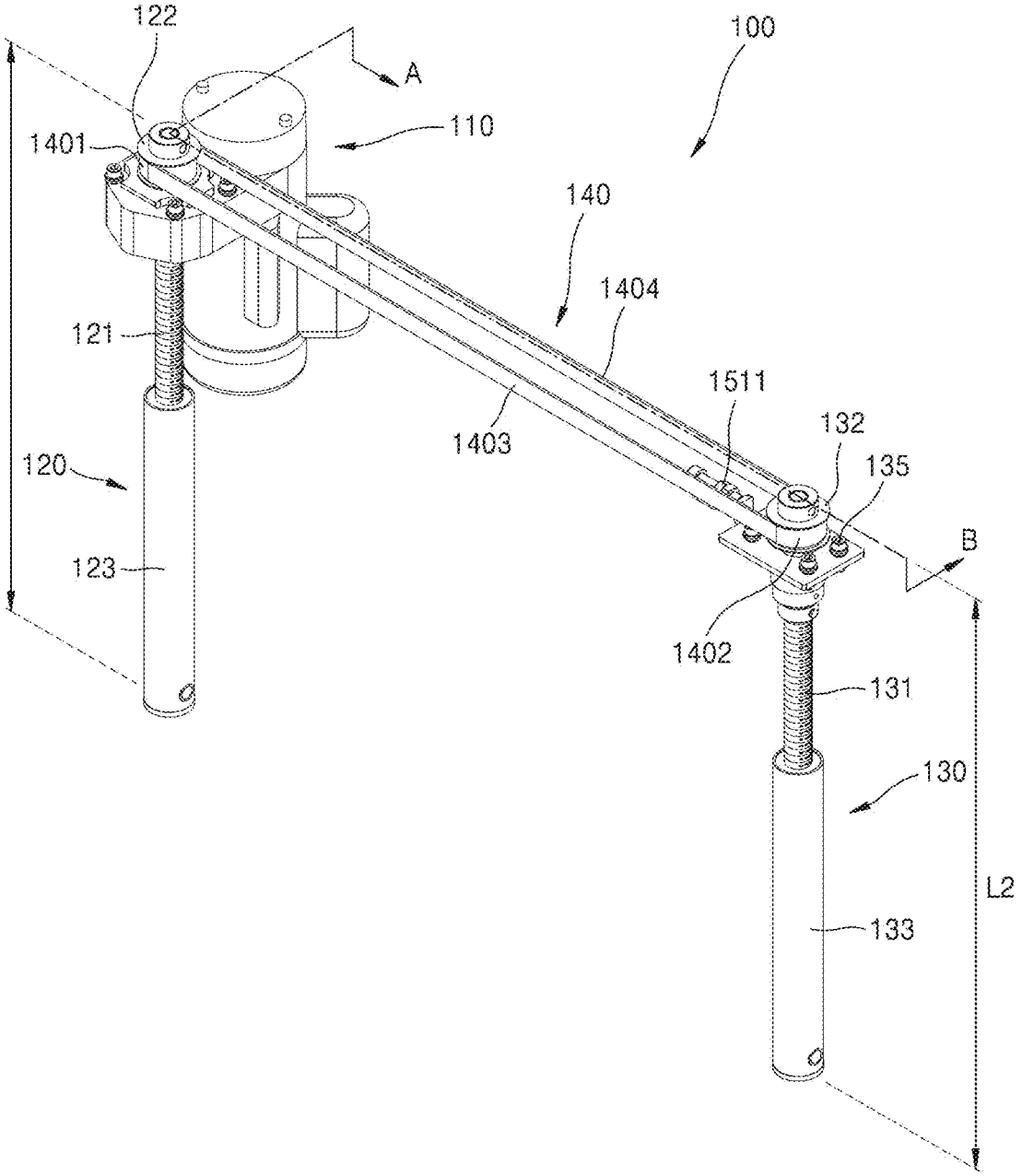
FIG. 8 is a perspective view of the length adjustment module of FIG. 6 with a module box omitted therefrom.
Figure 9:
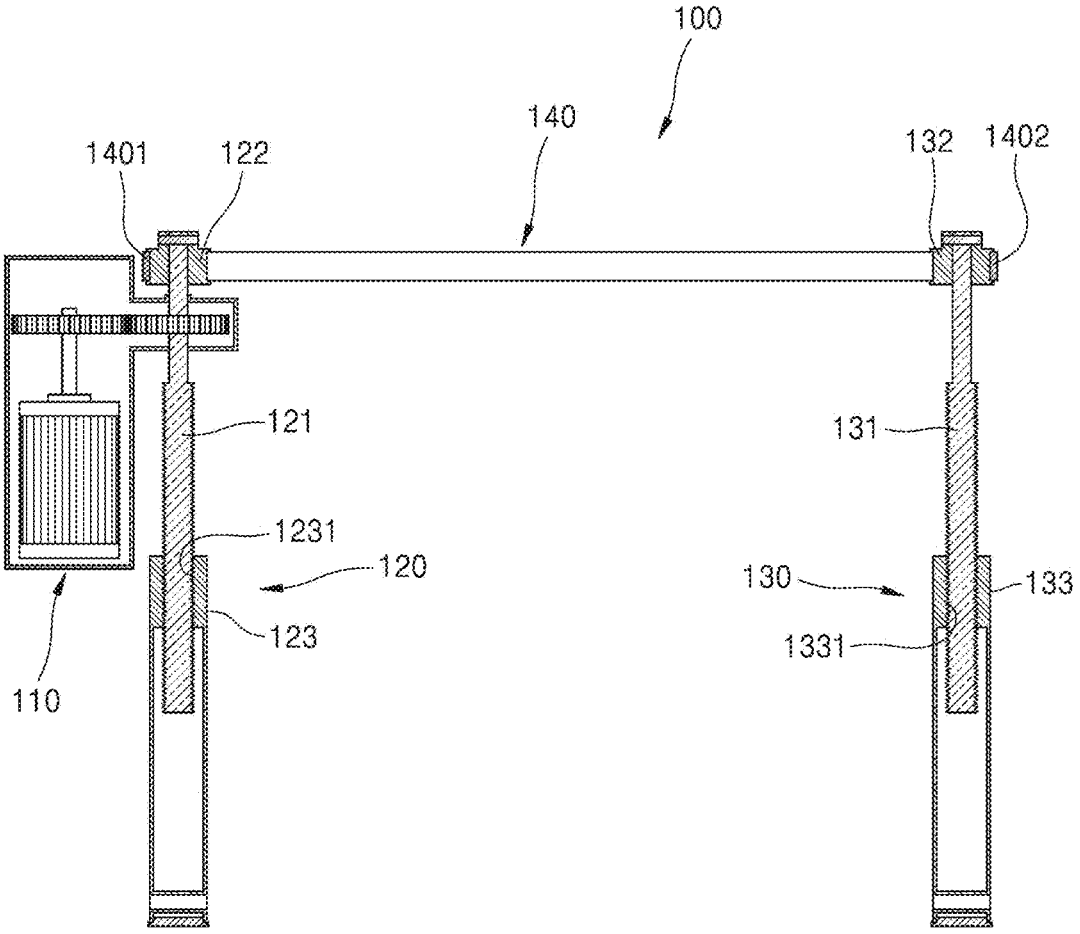
FIG. 9 is a cross-sectional view of the length adjustment module of FIG. 8 taken along a line AB.

FIG. 5 is a diagram illustrating a state in which the upper cover 35 is removed from the treadmill 1 according to embodiments, and FIG. 6 is a perspective view illustrating the length adjustment module 100 of FIG. 5 at another angle. FIG. 7 is a plan view of the length adjustment module 100 of FIG. 6, FIG. 8 is a perspective view of the length adjustment module 100 of FIG. 6 with a module box 150 omitted therefrom, and FIG. 9 is a cross-sectional view of the length adjustment module 100 of FIG. 8 taken along a line AB.

Referring to FIGS. 5 to 9, the length adjustment module 100 may include a driving motor 110, first and second length adjustment members 120 and 130 adjustable in length by the driving motor 110, and a connection belt 140 connecting the first and second length adjustment members 120 and 130.

The first length adjustment member 120 may be arranged in parallel to the second length adjustment member 130. The first length adjustment member 120 and the second length adjustment member 130 may be simultaneously adjustable in length.

The first length adjustment member 120 may be integrally formed with the driving motor 110. The first length adjustment member 120 may be directly driven by the driving motor 110.

As the driving motor 110 is driven, a length L1 of the first length adjustment member 120 connected to the driving motor 110 may be adjusted. Through the first length adjustment member 120 and the connection belt 140, the driving force of the driving motor 110 may be transmitted to the second length adjustment member 130, and in this process, a length L2 of the second length adjustment member 130 may be adjusted.

As such, because the inclination adjustment apparatus 40 has a structure in which the inclination thereof is adjusted as the length thereof is adjusted by two length adjustment members 120 and 130, the inclination adjustment apparatus 40 may prevent the horizontal shaking of the track unit 10.

The first length adjustment member 120 may include a driving screw 121 rotatably driven by the driving motor 110, a driving pulley 122 arranged at an end portion of the driving screw 121 and partially wound by the connection belt 140, and a first movement unit 123 having a driving female screw unit 1231 formed at an inner circumferential surface thereof and engaging with a thread of the driving screw 121.

The driving screw 121 may be rotated by the driving motor 110 and the first movement unit 123 may be moved in the lengthwise direction thereof by the rotation of the driving screw 121. For example, as the driving screw 121 rotates in the clockwise direction, the first movement unit 123 may move in the direction toward the driving screw 121 and accordingly the length L1 of the first length adjustment member 120 may decrease. For example, as the driving screw 121 rotates in the counterclockwise direction, the first movement unit 123 may move in the direction away from the driving screw 121 and accordingly the length L1 of the first length adjustment member 120 may increase.

The second length adjustment member 130 may include a driven screw 131 arranged in parallel to the driving screw 121, a driven pulley 132 arranged at an end portion of the driven screw 131 and partially wound by the connection belt 140, and a second movement unit 133 having a driven female screw unit 1331 formed at an inner circumferential surface thereof and engaging with a thread of the driven screw 131.

As the driving pulley 122 is rotated, the driven pulley 132 connected by the connection belt 140 may be rotated. The driven screw 131 may be rotated by the rotation of the driven pulley 132 and accordingly the second movement unit 133 may be moved in the lengthwise direction thereof. For example, as the driven screw 131 rotates in the clockwise direction, the second movement unit 133 may move in the direction toward the driven screw 131 and accordingly the length L2 of the second length adjustment member 130 may decrease. For example, as the driven screw 131 rotates in the counterclockwise direction, the second movement unit 133 may move in the direction away from the driven screw 131 and accordingly the length L2 of the second length adjustment member 130 may increase.

The connection belt 140 may be configured to connect the driving pulley 122 to the driven pulley 132 to transmit the driving force from the driving pulley 122 to the driven pulley 132.

As the configuration of connecting the driving pulley 122 to the driven pulley 132, a plurality of connection gears may be considered instead of the connection belt 140. However, the plurality of connection gears may not only increase weight and cost but also generate noise that may cause inconvenience to the user. In contrast, compared to the plurality of connection gears, the connection belt 140 may not only reduce the weight and cost but also minimize the noise.

The connection belt 140 may include a first curved section 1401 wound around the first length adjustment member 120, a second curved section 1402 wound around the second length adjustment member 130, a first linear section 1403 connecting one end portion of the first curved section 1401 to one end portion of the second curved section 1402, and a second linear section 1404 connecting the other end portion of the first curved section 1401 to the other end portion of the second curved section 1402 and corresponding to the first linear section 1403.

The first linear section 1403 may extend from the first curved section 1401, the second curved section 1402 may extend from the first linear section 1403, the second linear section 1404 may extend from the second curved section 1402, and the first curved section 1401 may extend from the second linear section 1404.

As an example where the second linear section 1404 corresponds to the first linear section 1403, the length of the second linear section 1404 may be equal to the length of the first linear section 1403 and the second linear section 1404 may be parallel to the first linear section 1403.

Although not illustrated, as an example where the second linear section 1404 corresponds to the first linear section 1403, when the diameter of the driving pulley 122 is different from the diameter of the driven pulley 132, the length of the second linear section 1404 may be equal to the length of the first linear section 1403 and the second linear section 1404 may not be parallel to the first linear section 1403.

The connection belt 140 may include a material that is elastically deformed. For example, the connection belt 140 may include rubber.

The length adjustment module 100 may further include a module box 150 in which the driving pulley 122, the driven pulley 132, and the connection belt 140 are stored. The module box 150 may be arranged inside the track driving unit 30. The module box 150 may be arranged in front of the track driving motor 31.

The length adjustment module 100 may further include a tension applying structure 151 for pressing the second length adjustment member 130 away from the first length adjustment member 120.

When the second length adjustment member 130 is pressed away from the first length adjustment member 120 by the tension applying structure 151, the connection belt 140 may be elastically deformed and in this process, the connection belt 140 may closely contact the first and second length adjustment members 120 and 130.

The tension applying structure 151 may include a pressing member 1511 installed at the module box 150 to press the second length adjustment member 130 and a plurality of slot holes 1512 arranged at the module box 150 and extending in the pressing direction of the pressing member 1511. A fixing member 135 for fixing the second length adjustment member 130 to the module box 150 may be inserted into the plurality of slot holes 1512.

In an assembly process, the fixing member 135 may be fixed to the plurality of slot holes 1512 in a state where the second length adjustment member 130 is pressed away from the first length adjustment member 120 by the pressing member 1511. Accordingly, the connection belt 140 wound around the driving pulley 122 and the driven pulley 132 may be elastically pressed and the connection belt 140 may closely contact the driving pulley 122 and the driven pulley 132. The first curved section 1401 may contact the driving pulley 122 and the second curved section 1402 may contact the driven pulley 132.

Lengths L31 and L32 of the first linear section 1403 and the second linear section 1404 may be equal to each other. A distance G between the first linear section 1403 and the second linear section 1404 may correspond to the diameter of the driving pulley 122 or the diameter of the driven pulley 132.

As the distance G between the first linear section 1403 and the second linear section 1404 decreases to correspond to the diameter of the driving pulley 122 or the driven pulley 132, a width W of the module box 150 may be designed to be small.

For example, the width W of the module box 150 may be less than about 120% of the diameter of the driving pulley 122. For example, the width W of the module box 150 may be less than or equal to about 70 mm. In this case, the width W of the module box 150 may be larger than the diameter of the driving pulley 122.

At both side portions of the module box 150, a support pole 160 may be arranged to pivotably support the module box 150. A pivot shaft 152 of the module box 150 may be pivotably supported by the support pole 160.

The module box 150 may pivot around a virtual line VL connecting a rotation axis A1 of the driving pulley 122 to a rotation axis A2 of the driven pulley 132.

By reducing the size of the module box 150, the rotation radius of the module box 150 may be reduced. Accordingly, a height h1 of the support pole 160 supporting the module box 150 may be lowered. For example, the height h1 of the support pole 160 may be less than or equal to about 12 cm. Here, the height of the support pole 160 may be defined as the height h1 from the upper surface of the track belt 11.

As the height h1 of the support pole 160 is lowered, the height of the front housing 33 may be designed to be low. The height of the upper cover 35 may be designed to be low. For example, a maximum height h2 of the front housing 33 with respect to the track unit 10 may be less than or equal to about 15 cm.

As described above, because the driving motor 110 may be driven to adjust the length L1 of the first length adjustment member 120 and the second length adjustment member 130 may be driven by the first length adjustment member 120 through the connection belt 140 to adjust the length L2 of the second length adjustment member 130, it may be advantageous in various aspects.

First, as described above, because the first length adjustment member 120 and the second length adjustment member 130 spaced apart from each other are connected by the connection belt 140, the space occupied by the connection belt 140 may be reduced. Accordingly, the rotation radius of the module box 150 storing the connection belt 140 may be reduced and the height of the track driving unit 30 may be lowered. This may achieve the effect of improving the design of the treadmill 1.

Next, the left and right weights of the treadmill 1 may be designed in a balanced manner. In general, the track driving motor 31 may be heavier than the driving motor 110 of the inclination adjustment apparatus 40. For example, the weight of the track driving motor 31 may be about 12 kg to about 20 kg, whereas the weight of the driving motor 110 of the inclination adjustment apparatus 40 may be about 2 kg to about 5 kg.

In the process of designing the driving motor 110 to be connected to the first length adjustment member 120, the relatively heavy track driving motor 31 may be arranged to be relatively close to the center between the driving pulley 122 and the driven pulley 132 and the relatively light driving motor 110 may be arranged to be relatively far from the center between the driving pulley 122 and the driven pulley 132.

For example, a distance G1 from the center of the track driving motor 31 to the center between the driving pulley 122 and the driven pulley 132 in the direction perpendicular to the rotation direction of the track belt 11 may be about 130 mm to about 200 mm and a distance G2 from the center of the driving motor 110 to the center between the driving pulley 122 and the driven pulley 132 in the direction perpendicular to the rotation direction of the track belt 11 may be about 270 mm to about 320 mm.

As such, by arranging the track driving motor 31 and the driving motor 110 in consideration of their respective weights, the horizontal shaking of the treadmill 1 may be minimized. Here, the center between the driving pulley 122 and the driven pulley 132 may coincide with the center of the front housing 33.

Meanwhile, in the above embodiments, an example where the inclination adjustment apparatus 40 is used in the treadmill 1 has been mainly described. However, the inclination adjustment apparatus 40 according to embodiments is not limited thereto and may be variously applied to any other apparatuses requiring inclination adjustment.

Figure 10:
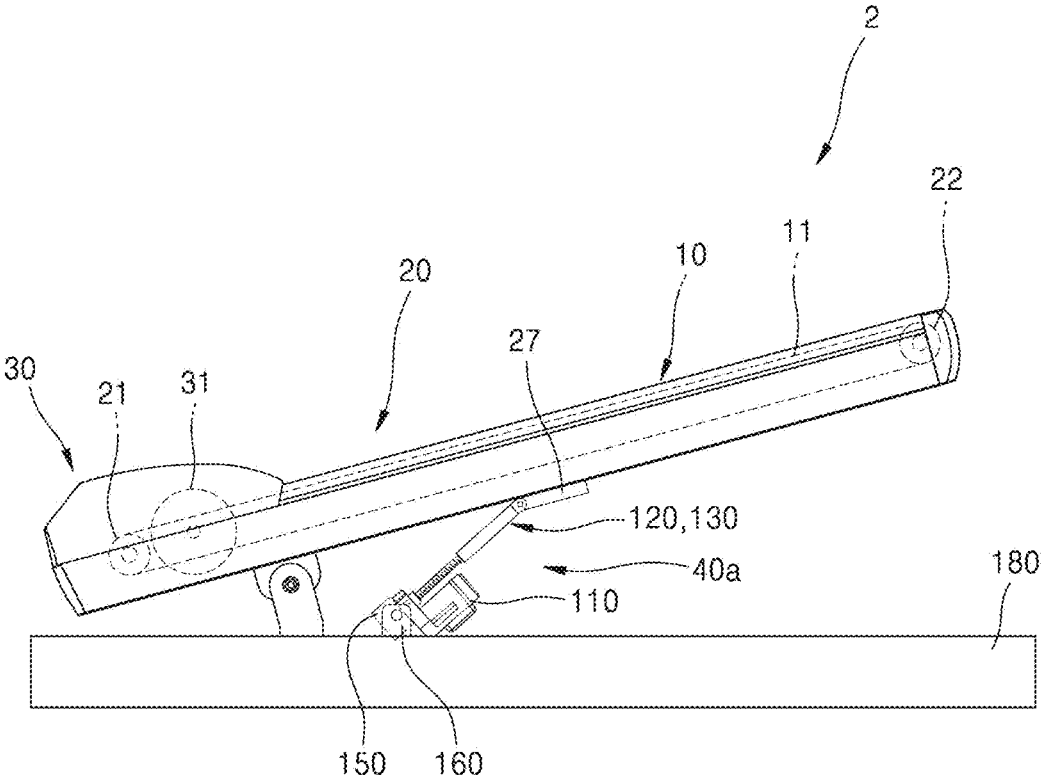
FIG. 10 is a diagram illustrating an inclination adjustment apparatus applied to an exercise machine according to other embodiments.

FIG. 10 is a diagram illustrating an inclination adjustment apparatus 40*a* applied to an exercise machine 2 according to other embodiments. Referring to FIG. 10, the exercise machine 2 according to embodiments may include a track unit 10, a support apparatus 20 rotatably supporting the track unit 10, a track driving unit 30 rotatably driving the track unit 10, and the inclination adjustment apparatus 40*a* adjusting the inclination of the track unit 10. The support apparatus 20 may be pivotably supported with respect to a base unit 180.

The inclination adjustment apparatus 40*a* may be arranged under the track unit 10. The inclination adjustment apparatus 40*a* may include a driving motor 110, first and second length adjustment members 120 and 130 adjustable in length by the driving motor 110, and a connection belt 140 (see FIG. 7) connecting the first and second length adjustment members 120 and 130.

One end portion of the first and second length adjustment members 120 and 130 may be pivotably connected to a connection unit 27 of the support apparatus 20. In a module box 150, a driving pulley 122 (see FIG. 7), a driven pulley 132 (see FIG. 7), and a connection belt 140 connecting them may be stored. The module box 150 may be pivotably supported by a support pole 160 of the base unit 180.

Meanwhile, in the above embodiments, an example where the length adjustment module 100 including the pair of length adjustment members 120 and 130 is applied to the inclination adjustment apparatus 40 has been mainly described. However, the application of the length adjustment module 100 is not limited to the inclination adjustment apparatus 40 and it may be applied to various apparatuses.

According to the length adjustment module, the inclination adjustment apparatus, and the treadmill including the same according to embodiments of the present disclosure, the stability of the track unit may be improved while simplifying the structure thereof and minimizing the size increase thereof.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A treadmill comprising:

a track unit;

a support apparatus rotatably supporting the track unit; and an inclination adjustment apparatus configured to adjust an inclination of the track unit, wherein the inclination adjustment apparatus includes a length adjustment module of which a length is adjustable and is configured to vary an inclination angle of the track unit with respect to a floor as the length thereof is adjusted, wherein the length adjustment module includes:

a driving motor;

a first length adjustment member of which a length is adjustable by a driving force of the driving motor;

a connection belt partially wound around the first length adjustment member; and a second length adjustment member arranged in parallel to the first length adjustment member, connected to the first length adjustment member by the connection belt, and having a length that is adjustable by the driving force received from the driving motor through the first length adjustment member and the connection belt, wherein the first length adjustment member includes:

a driving screw rotatably driven by the driving motor;

a driving pulley arranged at an end portion of the driving screw and around which the connection belt is partially wound; and a first movement unit configured to move in a lengthwise direction thereof and having a driving female screw unit formed at an inner circumferential surface thereof and configured to engage with a thread of the driving screw, wherein the second length adjustment member includes:

a driven screw arranged in parallel to the driving screw;

a driven pulley arranged at an end portion of the driven screw and around which the connection belt is partially wound; and a second movement unit configured to move in a lengthwise direction thereof and having a driven female screw unit formed at an inner circumferential surface thereof and configured to engage with a thread of the driven screw, wherein the length adjustment module further includes a motor housing in which the driving motor is housed, and wherein the driving screw passes through a portion of the motor housing for being indirectly coupled to the driving motor such that the driving screw is driven by the driving force of the driving motor without contacting the connection belt.

2. The treadmill of claim 1, wherein a distance between the first linear section and the second linear section of the connection belt corresponds to a diameter of the driving pulley or a diameter of the driven pulley.

3. The treadmill of claim 2, further comprising a module box configured to house the driving pulley, the driven pulley, and the connection belt.

4. The treadmill of claim 3, wherein a width of the module box is greater than the diameter of the driving pulley and less than or equal to about 70 mm.

5. The treadmill of claim 3, further comprising a support pole configured to support the module box to be pivotable around a virtual line connecting a rotation axis of the driving pulley to a rotation axis of the driven pulley.

6. The treadmill of claim 5, wherein a height of the support pole is less than or equal to about 12 cm.

7. The treadmill of claim 5, further comprising a track driving unit arranged in front of the track unit to rotatably drive the track unit, wherein the track driving unit includes:

a front housing; and a track driving motor housed in the front housing to rotatably drive the track unit.

8. The treadmill of claim 7, wherein the support pole is arranged in the front housing, and wherein a maximum height of the front housing with respect to the track unit is less than or equal to about 15 cm.

9. The treadmill of claim 7, wherein the track driving motor is heavier than the driving motor, and wherein the track driving motor is arranged to be closer to a center of the front housing than the driving motor.

10. The treadmill of claim 1, wherein the length adjustment module further comprises gears housed in the motor housing and configured to convey the driving force from the motor to the driving screw, wherein one of the gears is coupled to a shaft of the driving motor and another gear is coupled to the driving screw such that the driving screw is driven by the driving force of the driving motor without contacting the connection belt.

11. The treadmill of claim 1, wherein the portion of the motor housing is disposed between the driving pulley and the first movement unit.

12. A treadmill comprising:

a track unit;

a support apparatus rotatably supporting the track unit; and an inclination adjustment apparatus configured to adjust an inclination of the track unit, wherein the inclination adjustment apparatus includes a length adjustment module of which a length is adjustable and is configured to vary an inclination angle of the track unit with respect to a floor as the length thereof is adjusted, wherein the length adjustment module includes:

a driving motor;

a first length adjustment member of which a length is adjustable by a driving force of the driving motor;

a connection belt partially wound around the first length adjustment member; and a second length adjustment member arranged in parallel to the first length adjustment member, connected to the first length adjustment member by the connection belt, and having a length that is adjustable by the driving force received from the driving motor through the first length adjustment member and the connection belt, wherein the connection belt includes:

a first curved section wound around the first length adjustment member;

a second curved section wound around the second length adjustment member;

a first linear section configured to connect one end portion of the first curved section to one end portion of the second curved section; and a second linear section configured to connect another end portion of the first curved section to another end portion of the second curved section and corresponding to the first linear section, and wherein the treadmill further comprises a tension applying structure configured to press the second length adjustment member away from the first length adjustment member.

13. An inclination adjustment apparatus comprising a length adjustment module of which a length is adjustable to adjust an inclination of a track unit, wherein the length adjustment module includes:

a driving motor;

a first length adjustment member of which a length is adjustable by a driving force of the driving motor;

a connection belt partially wound around the first length adjustment member; and a second length adjustment member arranged in parallel to the first length adjustment member, connected to the first length adjustment member by the connection belt, and having a length adjustable by the driving force of the driving motor received through the first length adjustment member and the connection belt, wherein the first length adjustment member includes:

a driving screw rotatably driven by the driving motor;

a driving pulley arranged at an end portion of the driving screw and around which the connection belt is partially wound; and a first movement unit configured to move in a lengthwise direction thereof and having a driving female screw unit formed at an inner circumferential surface thereof and configured to engage with a thread of the driving screw, wherein the second length adjustment member includes:

a driven screw arranged in parallel to the driving screw;

a driven pulley arranged at an end portion of the driven screw and around which the connection belt is partially wound; and a second movement unit configured to move in a lengthwise direction thereof and having a driven female screw unit formed at an inner circumferential surface thereof and configured to engage with a thread of the driven screw, wherein the length adjustment module further includes a motor housing in which the driving motor is housed, and wherein the driving screw passes through a portion of the motor housing for being indirectly coupled to the driving motor such that the driving screw is driven by the driving force of the driving motor without contacting the connection belt.

14. A length adjustment module of which a length is adjustable, the length adjustment module comprising:

a driving motor;

a first length adjustment member of which a length is adjustable by a driving force of the driving motor;

a connection belt partially wound around the first length adjustment member; and a second length adjustment member arranged in parallel to the first length adjustment member, connected to the first length adjustment member by the connection belt, and having a length adjustable by the driving force of the driving motor received through the first length adjustment member and the connection belt, and wherein the first length adjustment member includes:

a driving screw rotatably driven by the driving motor;

a driving pulley arranged at an end portion of the driving screw and around which the connection belt is partially wound; and a first movement unit configured to move in a lengthwise direction thereof and having a driving female screw unit formed at an inner circumferential surface thereof and configured to engage with a thread of the driving screw, wherein the second length adjustment member includes:

a driven screw arranged in parallel to the driving screw;

a driven pulley arranged at an end portion of the driven screw and around which the connection belt is partially wound; and a second movement unit configured to move in a lengthwise direction thereof and having a driven female screw unit formed at an inner circumferential surface thereof and configured to engage with a thread of the driven screw, wherein the length adjustment module further includes a motor housing in which the driving motor is housed, and wherein the driving screw passes through a portion of the motor housing for being indirectly coupled to the driving motor such that the driving screw is driven by the driving force of the driving motor without contacting the connection belt.

15. A treadmill comprising:

a track unit;

a support apparatus rotatably supporting the track unit; and an inclination adjustment apparatus configured to adjust an inclination of the track unit, wherein the inclination adjustment apparatus includes a length adjustment module of which a length is adjustable and is configured to vary an inclination angle of the track unit with respect to a floor as the length thereof is adjusted, wherein the length adjustment module includes:

a driving motor;

a first length adjustment member of which a length is adjustable by a driving force of the driving motor;

a connection belt partially wound around the first length adjustment member; and a second length adjustment member arranged in parallel to the first length adjustment member, connected to the first length adjustment member by the connection belt, and having a length that is adjustable by the driving force received from the driving motor through the first length adjustment member and the connection belt, wherein the first length adjustment member includes:

a driving screw rotatably driven by the driving motor;

a driving pulley arranged at an end portion of the driving screw and around which the connection belt is partially wound; and a first movement unit configured to move in a lengthwise direction thereof and having a driving female screw unit formed at an inner circumferential surface thereof and configured to engage with a thread of the driving screw, wherein the second length adjustment member includes:

a driven screw arranged in parallel to the driving screw;

a driven pulley arranged at an end portion of the driven screw and around which the connection belt is partially wound; and a second movement unit configured to move in a lengthwise direction thereof and having a driven female screw unit formed at an inner circumferential surface thereof and configured to engage with a thread of the driven screw, and wherein the treadmill further includes:

a module box configured to store the driving pulley, the driven pulley, and the connection belt;

pivot shafts, each arranged adjacent to the center of one of both sides of the module box; and support poles, each supporting one of the pivot shafts such that the module box is pivotable around a virtual line transverse to a rotation axis of the driving pulley and a rotation axis of the driven pulley.

* * * * *